United States Patent [19]

Hamkins

[11] Patent Number: 4,884,758

[45] Date of Patent: Dec. 5, 1989

[54] SELF-LOADING WIRE WINDING ASSEMBLY AND METHOD

[75] Inventor: Clark J. Hamkins, Lexington, Ky.

[73] Assignee: Kuhlman Corporation, Troy, Mich.

[21] Appl. No.: 132,091

[22] Filed: Dec. 11, 1987

Related U.S. Application Data

[63] Continuation of Ser. No. 48,523, May 6, 1987, Pat. No. 4,771,957, which is a continuation of Ser. No. 698,981, Feb. 6, 1985, abandoned.

[51] Int. Cl.[4] ..... H01F 41/06

[52] U.S. Cl. ..... 242/4 BE; 242/7.14

[58] Field of Search ..... 242/1, 4 R, 4 B, 4 BE, 242/4 C, 7.03, 7.14; 29/605

[56] References Cited

U.S. PATENT DOCUMENTS

| | | | |
|---|---|---|---|
| 2,444,126 | 6/1948 | Wirth | 242/4 C |
| 2,588,139 | 3/1952 | McCarthy | 242/4 B |
| 2,974,890 | 3/1961 | Davis | 242/4 B |
| 3,125,308 | 3/1964 | Buralli | 242/4 BE |
| 3,383,059 | 5/1968 | Fahrbach . | |
| 3,459,385 | 8/1969 | Fahrbach . | |
| 4,007,881 | 2/1977 | Haslau et al. | 242/4 C X |

FOREIGN PATENT DOCUMENTS

| | | | |
|---|---|---|---|
| 694875 | 12/1930 | Fed. Rep. of Germany | 242/4 B |
| 1258952 | 3/1961 | France | 242/4 B |
| 157015 | 12/1981 | Japan | 242/4 C |
| 155017 | 6/1956 | Sweden | 242/4 B |
| 534838 | 3/1941 | United Kingdom | 242/4 BE |

*Primary Examiner*—Joseph J. Hail, III

*Attorney, Agent, or Firm*—Townsend and Townsend

[57] ABSTRACT

Apparatus for winding a continuous length of wire about a mandrel to create coils of wire uses a coil winding machine having a circular cage mounted to a frame and a circular winding magazine freely rotatably mounted to the frame within the cage to define an annular cavity between them. Initially a supply of wire is wound on the magazine, such as counterclockwise. The wire on the magazine continues to be connected as a continuous strand to a large, external spool of wire. A winding shuttle is driven along the annular cavity clockwise to remove wire from the magazine and wind it about a mandrel. Wire is removed from the magazine at double the rate at which it is wound about the mandrel. The excess wire initially expands within the cavity. The expansion is halted by the cage. Once all of the excess wire is restrained by the cage, the continued clockwise movement of the shuttle causes the excess wire to double back upon itself in a loop so the wire is rewound on the magazine in the clockwise direction. Once all the excess wire is wound back on the magazine, the magazine, previously substantially stationary, begins to rotate clockwise which causes wire from the external spool of wire to be wound onto the rotating magazine. This continues until the mandrel is fully wound with a coil segment. At this time sufficient wire has been wound onto the magazine to wind the next coil segment. The process repeats to wind subsequent coil segments in alternating rotary directions as the shuttle moves in alternating rotary directions.

18 Claims, 9 Drawing Sheets

SELF-LOADING WIRE WINDING ASSEMBLY AND METHOD

BACKGROUND OF THE INVENTION

The present invention is a continuation of application Ser. No. 048,523 filed May 6, 1987, now U.S. Pat. No. 4,771,957 which is a continuation of Ser. No. 698,981 now abandoned filed Feb. 6, 1985, each entitled Apparatus and Method for Fabricating a Low Voltage Winding for a Toroidal Transformer, the disclosure of which is incorporated by reference.

Examples of prior art toroidal coil winding machines using rotatable shuttles in magazines are found in Fahrbach U.S. Pat. Nos. 3,383,059 and 3,459,385 issued May 14, 1968 and Aug. 5, 1969, respectively. Such machines (hereinafter "Universal Machines") are sold by the Universal Manufacturing Company, Inc., 1168 Grove Street. Irvington. New Jersey 07111 under various model numbers.

SUMMARY OF THE INVENTION

Winding machines which wind a toroidal winding using a rotatable winding shuttle and an annular storage magazine passing through the window of a toroidal core are well known in the prior art, as exemplified by the aforementioned Universal Machines. Prior art winding machines can wind a toroidally-shaped multifilar winding so that the multifilar windings are laid side by side in a single layer at the radially-outward leg of the toroid and are laid in multiple or stacked layers at the radially-inward leg of the toroid. The present invention, however, constitutes a material modification of such earlier machines and depart from these machines in several important respects. Particularly, the machine and method of the present invention is adapted to automatically reload wire into the wire storage assembly during the winding cycle to eliminate the requirement that the winding process be interrupted periodically to wind new wire into a wire storage magazine.

In general, this application and the aforementioned copending application are directed to new apparatus and methods for winding a multifilar low voltage windings employing, typically, round, film insulated, wire conductors and an apparatus and method for fabricating a multifilar low voltage winding for toroidal transformer. The method and apparatus use a wire storage assembly including a rotatable, freewheeling magazine, a stationary cage circumscribing the magazine, and a wire winding shuttle which rotates in the cavity defined between the magazine and the cage. The magazine is preferably circular and has an open or hollow interior. An arcuate or toroidal winding mandrel is positioned within the hollow magazine so that the shuttle, as it rotates about the mandrel, winds a wire onto the mandrel. Wire is automatically fed into the cavity during a portion of each winding cycle. Since the wire used in the winding of the mandrel is automatically replenished, there is no requirement for interrupting the winding operation to load wire into the wire storage assembly.

Wire is removed from the wire storage assembly at a rate which differs significantly from the rate at which wire is replenished into the wire storage assembly. Therefore wire in the wire storage assembly is replenished during only a portion of the wire winding cycle.

Preferably, the magazine and the cage are mounted coaxially with the shuttle. The magazine has a radially-inward storage surface for storing wire. The cage has a surface which is located radially-outwardly of the corresponding surface of the magazine. The cage is fixed to the machine and therefore does not rotate.

Prior to the start of winding operations, the magazine is preloaded with a number of turns of wire equal to N/2 turns, where N is the number of turns wound on the coil in one winding pass. As will be seen from the following description. this initial winding of a supply of wire in the wire storage magazine is not repeated as successive segments are wound during successive winding cycles on the same or different mandrels as a result of the novel wire replenishment of the present invention.

The pre-wound, initial store of wire on the magazine is wound onto the mandrel by movement of the shuttle around the magazine. The shuttle picks up and removes wire from the magazine as it moves around the magazine. Each turn of wire on its mandrel requires a complete revolution of the shuttle around the mandrel. Since the average circumferential length of the mandrel is substantially less than the average circumferential length of the magazine, the length of wire removed from the magazine is much more than the length of wire wound about the mandrel. Thus, the shuttle unwinds the wire stored on the magazine at a rate greater than the wire is wound onto the mandrel. This excess unwinding causes the diameter of the coil of wire on the magazine to grow since this is the only manner in which the excess wire removed from the magazine can be accommodated.

As the shuttle continues to wind wire onto the mandrel, the wire from the magazine continues to be unwound from the magazine at a rate greater than the rate at which wire is wound onto the mandrel. Therefore, the coil of wire in the annular cavity between the magazine and the cage continues to grow in diameter until all of the turns of such coil abut and are constrained by the radially outward surface of the cage. After this occurs, further movement of the shuttle around the mandrel causes the wire to take a new path within the annular cavity. The wire being unwound from the magazine is thus caused to double up on itself, thereby forming a loop of wire in the cavity.

After formation of the loop of wire, the wire continues to be doubled back on itself and so to be wound onto the wire storage magazine in the opposite direction as the original coil of wire on the magazine. Note that this occurs while the shuttle continues to move around, and wind wire onto, the mandrel in the original direction. Continued movement of the shuttle in the original direction causes the wire, now abutting the cage, to unwind from the radially-outward surface of the cage, double back upon itself through the loop, and wind onto the radially-inward surface of the magazine. This action continues until all the wire stored on the radially-outward surface of the cage is wound onto the magazine. All during this time, the shuttle continues to wind wire onto the winding mandrel.

After all of the wire is transferred from the radially-outward surface of the cage back onto the radially-inward surface of the magazine, rotation of the shuttle continues to be in the original direction. This causes wire to continue to wind onto the mandrel in the original direction. This also causes wire, for the first time, to be pulled into the cavity and wound onto the freewheeling magazine from the external source of wire, e.g., a large supply wheel of wire. New wire is wound onto the magazine for the remainder of this original winding cycle during which wire is wound about the mandrel in the original direction. Sufficient wire is wound onto the magazine during this remainder of the original winding cycle, taking advantage of fact that the circumference of the magazine is much larger than the circumference of the winding mandrel, to supply again, N/2 turns of new wire on the magazine. The winding cycle ends when the mandrel has N turns of wire wound about it in the original direction. Start and finish coil leads are typically provided by winding a turn or two of magnet wire onto end fixtures of the winding mandrel prior to, and after the coil turns of wire have been wound onto the mandrel.

The above described operation then repeats on the same mandrel or a different mandrel. This subsequent winding cycle finds the shuttle moving about the mandrel in the opposite direction to wind the wire about the mandrel in the opposite direction. The reverse winding of the next cycle onto the same mandrel causes the wire loaded onto the radially-inward surface of the wire storage magazine to be wound off the wire storage magazine in the direction opposite the prior cycle. When the same mandrel is used for successive winding cycles, oppositely wound segments of a coil are created. The start and finish ends of these coil segments are usually then connected in parallel to provide a single winding of two or more wires effectively wound in the same direction with respect to the electromagnetic axis of coil and the conductor ends serve as lead extensions for termination at the transformer bushings.

While a full understanding of the present invention is best appreciated in the light of the detailed sequence drawings provided as part of the "Detailed Description of the Preferred Embodiment", it will be appreciated that the wire storage and winding method and apparatus of the present invention has certain characteristic features. Included among these are the following. The only operation in which wire is wound onto the storage magazine to store wire, which is not accomplished concurrently with winding of wire onto the mandrel, is the initial storage of wire onto the wire storage magazine. This occurs during setup of the machine prior to winding of the first segment of the first coil. Thereafter, no further separate operation is required to wind wire onto the magazine. Additionally, the structure has three main parts. The shuttle is driven by a suitable motor and typically winds at a constant rotation speed. The cage, fixed to the frame of the machine, is stationary. The wire magazine is freewheeling and therefore is independently rotatable of both the driven shuttle and the stationary cage. Any movement of the magazine occurs due to the pull or drag of the wire being extracted from the magazine by the shuttle during winding of wire on the mandrel. The initial loading of wire is accomplished by attaching the wire to the shuttle and then rotating the shuttle through N/2 revolutions to wind N/2 turns of wire onto the free-wheeling magazine. Alternatively, the magazine could be driven to wind the initial supply of wire prior to winding the first segment of the first coil.

Another significant feature of the present method and apparatus is the fact that wire is wound from the external supply onto the wire storage magazine only during a portion of the winding cycle. During all other times, the wire leading from the external supply of wire to the wire storage magazine remains generally stationary. Moreover, during the limited period in which wire from the external supply is wound onto the magazine, the rate at which wire is wound onto the wire storage magazine is much greater than the rate at which wire is wound onto the winding mandrel: the difference in rates is in proportion to the difference in the circumferential lengths of the magazine and the mandrel.

Finally, at least a portion of the wire initially loaded onto the magazine encounters three different storage phases or modes. The first storage mode finds the wire wound in the first or original direction on the radially-inward surface of the magazine, during which the wire on the magazine is stationary since the freewheeling magazine is essentially stationary. The second storage mode finds the wire located on the radially-outward surface of the cage, during which the wire is stationary with the stationary cage. The third storage mode finds the wire being rewound in a second or opposite direction onto the radially-inward surface of the magazine, during which the wire rotates with the freewheeling magazine.

Other features and advantages of the method and apparatus of the present invention will become apparent in view of the drawings described below and the more specific description of the invention appearing in the following "Detail Description of the Preferred Embodiment".

DETAILED DESCRIPTION OF THE PREFERRED EMBODIMENT

Figure 1:
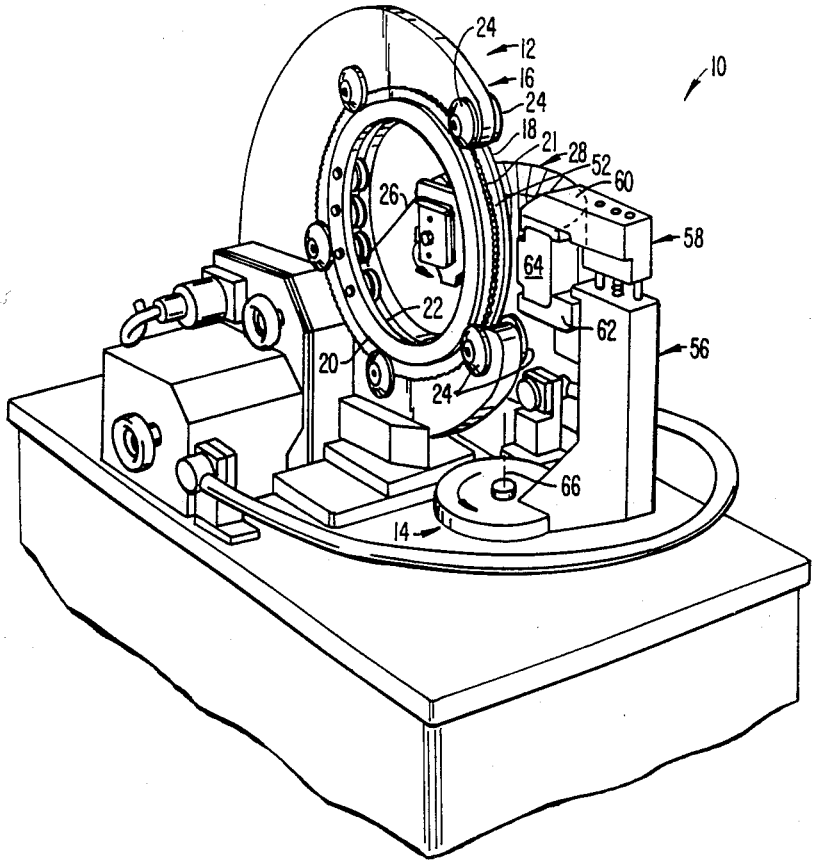
FIG. 1 is a perspective view showing a low voltage winding machine made according to the invention.
Figure 2:
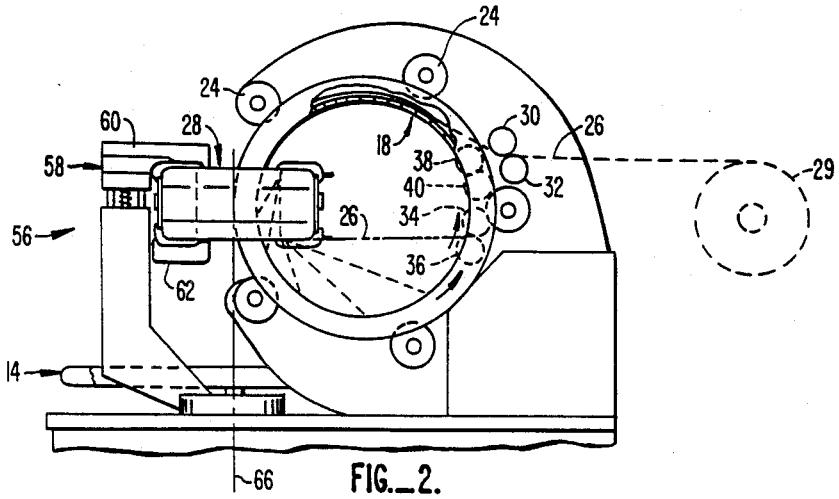
FIG. 2 is a somewhat simplified rightside view of the machine of FIG. 1.

In FIGS. 1 and 2, a preferred embodiment of a low voltage winding machine 10 of the present invention is illustrated. Although the machine is referred as a "low voltage" winding machine, it will be appreciated that this machine has application to windings of a form suitable to the machine regardless of the voltage rating or capability of the winding. The machine has general the model "DW" toroidal winding machine manufactured by Universal Manufacturing Company, Inc. of Irvington, New Jersey. However, the machine has a number of significant and important differences with respect to the aforementioned machine. The winding machine 10 includes a winding head assembly 12 and a rotary table assembly 14. Winding head assembly 12 includes a winding head frame 16 which in generally crescent-shaped as shown to provide a jaw having a circular central opening for containing an annular wire storage magazine 18, an annular winding shuttle 20 and an annular wire storage cage 22 (shown best in FIG. 4). Magazine 18 is mounted to be freely rotatable independently of both frame 16 and shuttle 20. Shuttle 20 includes an integral ring gear 21 by a suitable drive to be rotatably driven about its central axis. Cage 22 is fixed to frame 16 so as to be non-rotatable. Magazine 18 and shuttle 20 are mounted for their respective rotations with respect to frame 16 by several rotatable mounting wheels 24 distributed circumferentially about the circular jaw of frame 16 and located on respective sides of frame 16 to contain magazine 18 and shuttle 20.

Magazine 18 may be driven, during the initial loading of magazine 18 with wire 26, by a suitable electric or pneumatic motor or it may be driven by the action of shuttle 20 pulling wire onto it. Thereafter, magazine 18 is disconnected from its drive to be freewheeling. Magazine 18 is automatically replenished with wire 26 by the novel apparatus and method described below.

Winding machine 10 is adapted to wind wire 26 around a winding mandrel 28, for example, in a pattern as described in detail in the aforementioned copending application.

With reference now to FIGS. 2, 3, 4 and 9, wire 26 is guided from a supply source 29 for winding onto magazine 18 through wire guide pulleys 30 and 32. Shuttle 20 includes winding pulleys 34 and 36 for dispensing wire 26 to be wound on mandrel 28. Shuttle 20 also includes wire pick up pulleys 38 and 40 which retrieve wire 26 from magazine 18 and cage 22 and feed wire 26 to winding pulleys 34 and 36.

Figure 3:
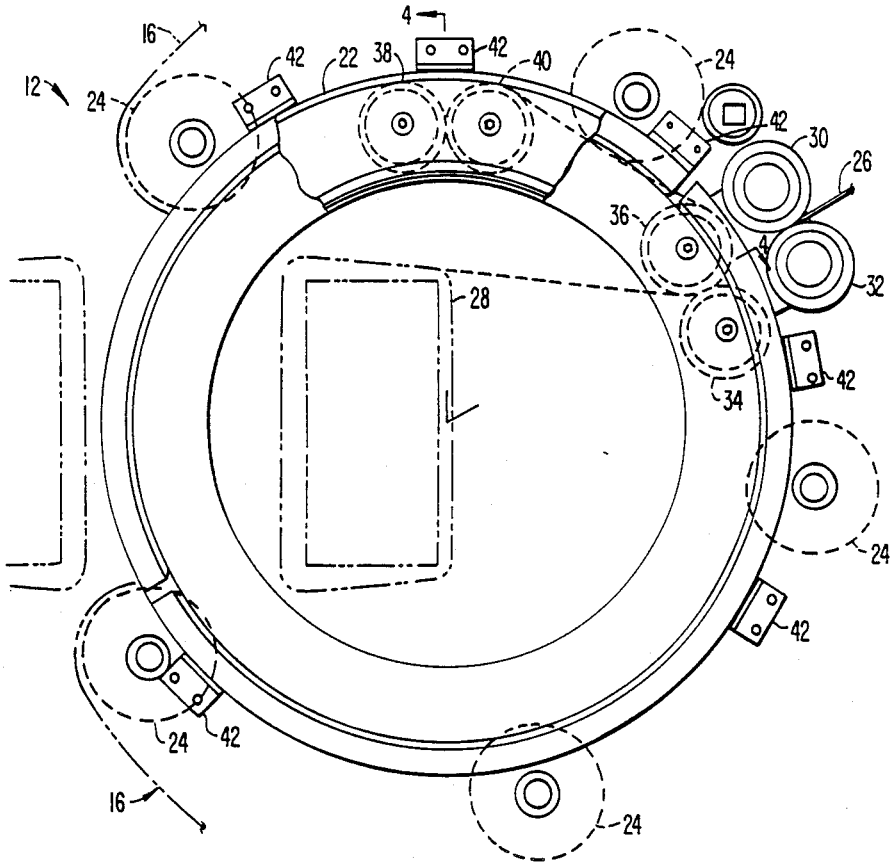
FIG. 3 is an enlarged simplified view illustrating the winding head assembly of FIG. 1.

As shown in FIG. 3, cage 22 is fixed to frame 16 using several cage attachment brackets 42 distributed about the periphery of cage 22.

Figure 4:
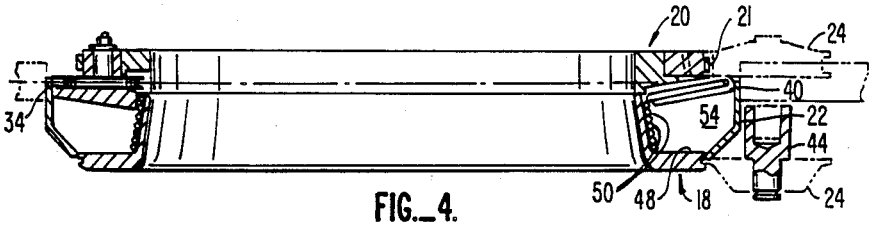
FIG. 4 is a cross-sectional view taken along line 4—4 of FIG. 3.
Figure 5:
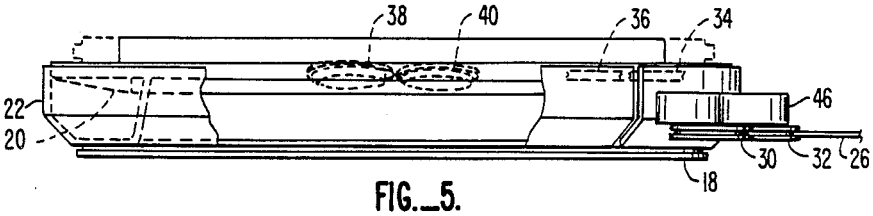
FIG. 5 is a top view of the winding head assembly of FIG. 3.

As can be best seen in FIG. 4, mounting wheels 24 on the right side of frame 16 are attached to frame 16 through the use of mounting wheel shafts 44. Wire guide pulleys 30 and 32 are mounted to frame 16 through wire guide pulley mounting blocks 46 as shown in Fig. 5. Magazine 18 has an annular L-shaped storage channel 48 (best shown in FIG. 4) for containing coils 50 of wire 26.

The ring gear 21 of winding shuttle 20 has gear teeth 52 (see FIG. 1) which engage a pinion (not shown) connected to a, preferably digitally controlled, drive motor (not shown). When driven, as explained in greater detail below, shuttle 20 retrieves wire 26 stored within the cavity 54 (see FIG. 4) formed by channel 48 of magazine 18 and cage 22 for winding upon mandrel 28.

As also discussed in greater detail below, wire 26 is retrieved with pick up pulleys 38 and 40 and is fed to mandrel 28 through winding pulleys 34 and 36. For this purpose, pick up pulleys 38 and 40 are provided with annular grooves for receiving wire 26 from cavity 54. Wire winding pulleys 34 and 36 are also provided with annular grooves for receiving the wire 26. Each wire winding pulley 34 and 36 is disposed so that one location on its periphery is generally aligned with the annular groove of the pick up pulleys 38 and 40 and another location on its periphery is positioned outside of the cavity 54 to conveniently feed the wire 26 from the interior of such cavity 54 to the exterior thereof for winding on the mandrel 28. The axes of the winding pulleys are parallel to the axis of the shuttle. The pick up pulleys are tilted so that their bottom edge can pick up wire easily from the magazine while their top edge is in line with the winding pulleys. Note that a pair of pick up pulleys 38 and 40 are provided and a pair of winding pulleys 34 and 36 are provided to accommodate rotation of the winding shuttle in both the clockwise and counter clockwise direction for winding wire 26 on mandrel 28 in both the clockwise and counter clockwise direction. For example, when shuttle 20 is driven clockwise. with reference to FIG. 9, winding pulley 34 dispenses wire 26 onto mandrel 28 while pick up pulley 40 typically (but not always) is used to retrieve wire from cavity 54 and feed such wire to winding pulley 34. On counter clockwise rotation of the winding shuttle 20. winding pulley 36 and pick up pulley 38 are employed (again generally, but not always).

Referring now to FIGS. 1 and 2, rotary table assembly 14 includes a mandrel support assembly 56, a mandrel clamp 58 having upper and lower jaws 60 and 62, respectively, for gripping a mounting portion 64 of winding mandrel 28. Winding mandrel 28 has an arcuate or semitoroidal configuration with the center of the arc or toroid located at the rotational axis 66 of rotary table assembly 14 such that rotation of the rotary table assembly 14 causes rotation of the arcuate winding mandrel 28 about its axis.

Figure 6:
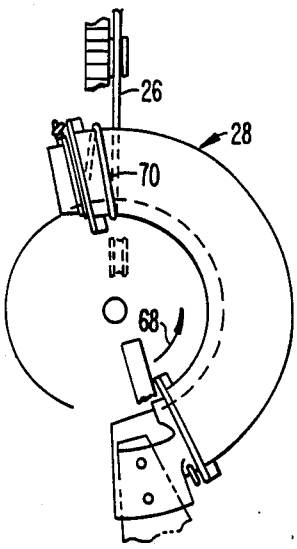
FIGS. 6 and 7 illustrate winding coils of wire in opposite directions onto a semi-toroidal mandrel.
Figure 7:
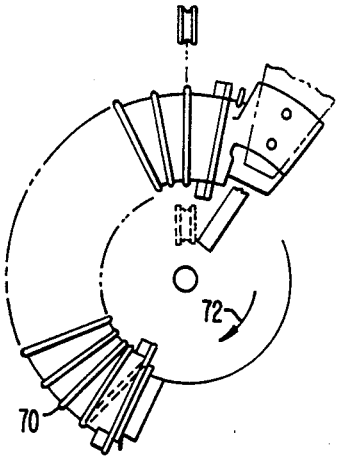
Figure 8:
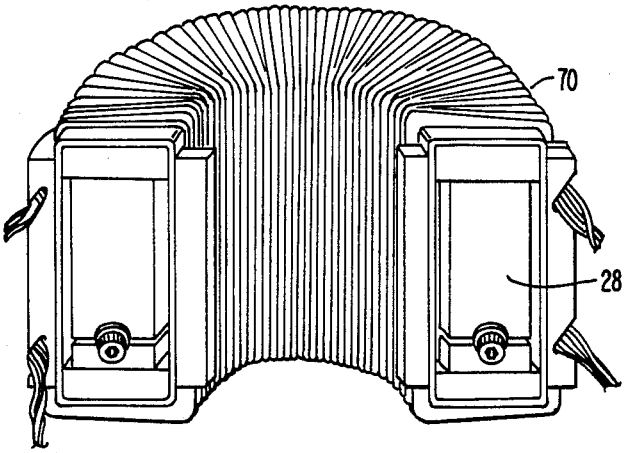
FIG. 8 shows a fully wound semi-toroidal transformer segment.

Assembly 14 is connected to suitable drive gears and a digitally-controlled motor (neither shown) to provide precise programmable orientation of winding mandrel 28 during the rotation of shuttle 20 to wind wire 26 onto mandrel 28 in pre-defined patterns. For example, as illustrated in FIG. 6, a layer of wire 26 can be wound upon mandrel 28 by moving shuttle 20 in a counter clockwise direction (as viewed from the right in FIG. 6) around mandrel 28 while mandrel 28 rotates in a counter clockwise direction as indicated by arrow 68. After a first layer 70 of wire 26 is laid upon mandrel 28, the winding shuttle 20 is rotated clockwise while the winding mandrel 28 is rotated clockwise, as illustrated by arrow 72 in FIG. 7, to lay a second layer of the wire 26 on mandrel 38. This process may continue until the desired number of layers of wire are completed. As disclosed in the copending application, the winding mandrel 28 can accomplish certain reciprocal "jogging" motions during rotation of the winding shuttle 20 to provide a nonspiral winding which facilitates precise placement of the wires for minimum coil volume.

According to the present invention, wire 26 is wound from supply source 29 onto wire storage magazine 18 during only a portion of the winding cycle of each segment or direction of winding of the mandrel 28. The wire 26 wound upon wire storage magazine 18 during such winding portion becomes the supply source of wire 26 used to wind the next coil segment during the next winding cycle. This permits the winding operation to be continuous without interruption for the purpose of replenishing the supply of wire 26 in wire storage magazine 18. In the prior art winding machines, a new supply of wire was wound onto the wire storage magazine from time to time. Upon each resupply, winding of wire onto the mandrel was interrupted. Such interruptions, of course, increased the down time of the machine, increased the time required to produce a winding, increased the labor required to operate the machine, and created a waste of wire as wire left in the magazine was thrown away. In this regard, after filling the magazine with the fresh supply of wire, the wire from the supply was cut so that the winding operation could proceed. Since it was not possible to predict with certainty the length of wire required for the winding operation, and some length of wire was needed in order to assure proper wire wrap and tension, each such resupply operation caused a length of wire, often extensive, to be waste.

In FIGS. 9 through 19, a series of illustrations is provided which show the sequence of operations by which wire 26 is unwound from magazine 18 and onto mandrel 28. The figures also show the replenishing of wire 26 from source of supply 29 and onto magazine 18 during a portion of the cycle. Magazine 18 is illustrated as forming a radially inward storage surface 74 partially defining cavity 54 while cage 22 is shown as providing a radially outward storage surface 76 of cavity 54. Note that in FIGS. 9 through 19, the component parts of the winding machine 10 are shown in simplified form to facilitate an explanation and understanding of the features and advantages of the present invention.

Figure 9:
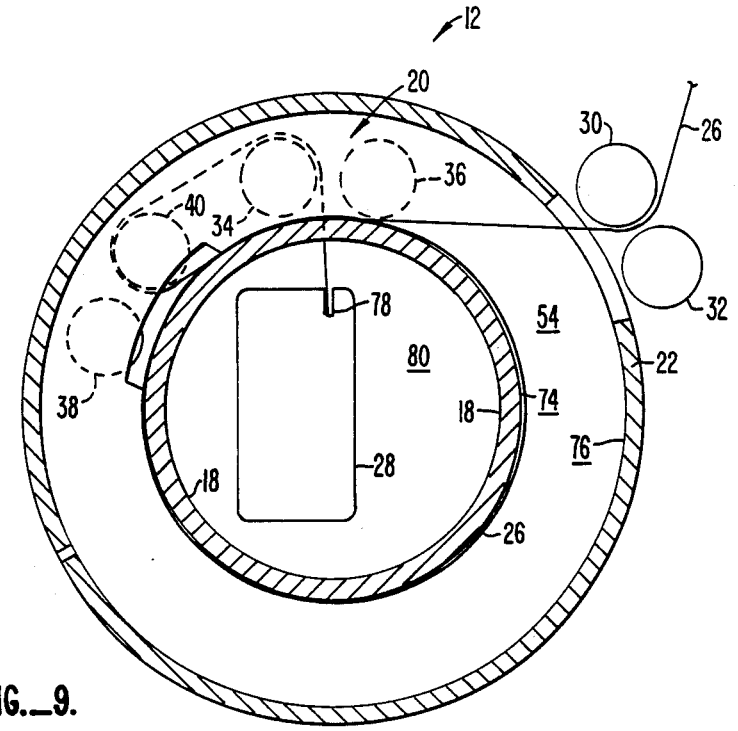
FIGS. 9–19 illustrate the sequence of events which occur during one winding cycle.
Figure 10:
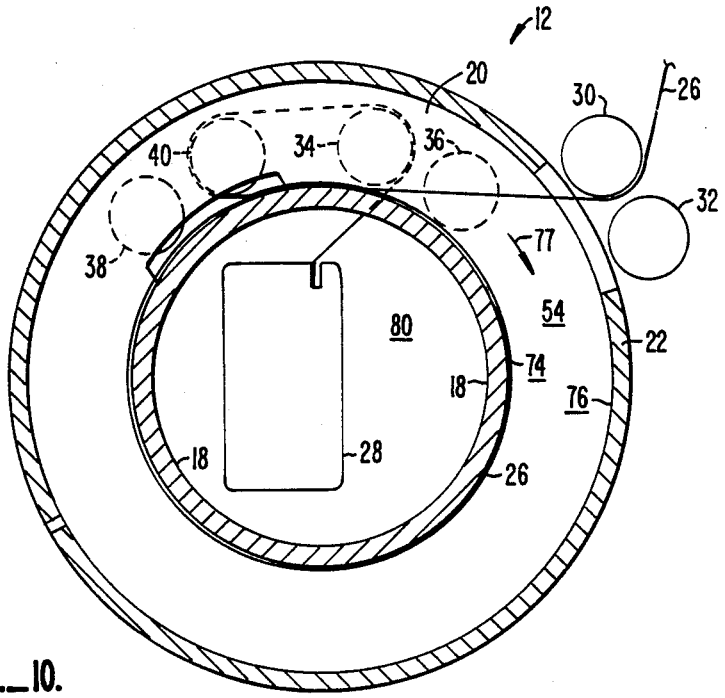

In FIG. 9, the starting conditions of various components of machine 10 before winding a coil 70 of wire 26 on mandrel 28 are illustrated. At this point, a supply of wire 26 equal to N/2 turns of wire has been wound from supply 29 onto radially inward surface 74 of magazine 18. That initial winding step, as will be apparent hereafter, need only be accomplished at the beginning of winding operations, and need not be repeated until all wire 26 on supply 29 has been exhausted and a new supply is provided.

N/2 turns of wire on the magazine is the amount required to end up at the end of a winding pass with the same amount of wire on the magazine as when you started. If you started with (N/2−K) turns on the magazine you would end up with (N/2+K) turns on the magazine, and vice versa. N/2 turns minimizes the maximum amount of wire that the magazine has at any time.

Figure 18:
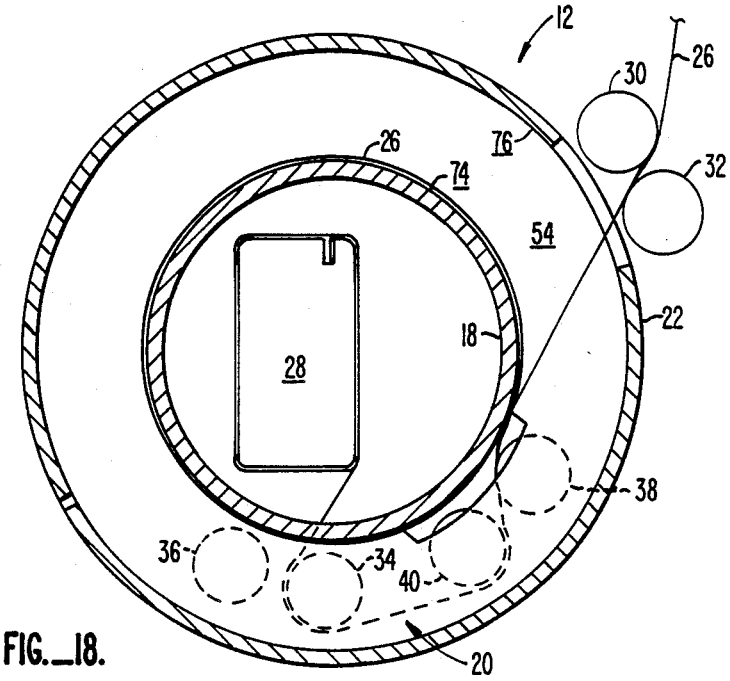
Figure 19:
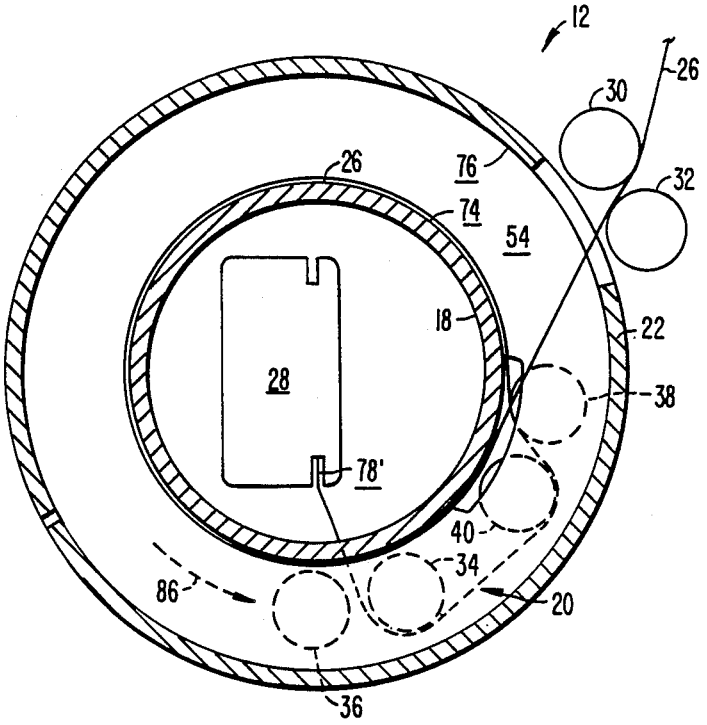

FIGS. 9 and 19 show winding head assembly 12 with winding shuttle 20 stationary just before starting a new winding cycle. Shuttle 20 in FIGS. 10–18 constantly rotates in a clockwise direction as indicated by arrow 77. Also note that wire 26 between wire guide pulleys 30, 32 and supply 29 is stationary in FIGS. 9–16, 18 and 19. Only during that portion of the winding cycle illustrated in FIG. 17 is wire 26 drawn into cavity 54 from supply 29, as will be discussed below.

Figure 11:
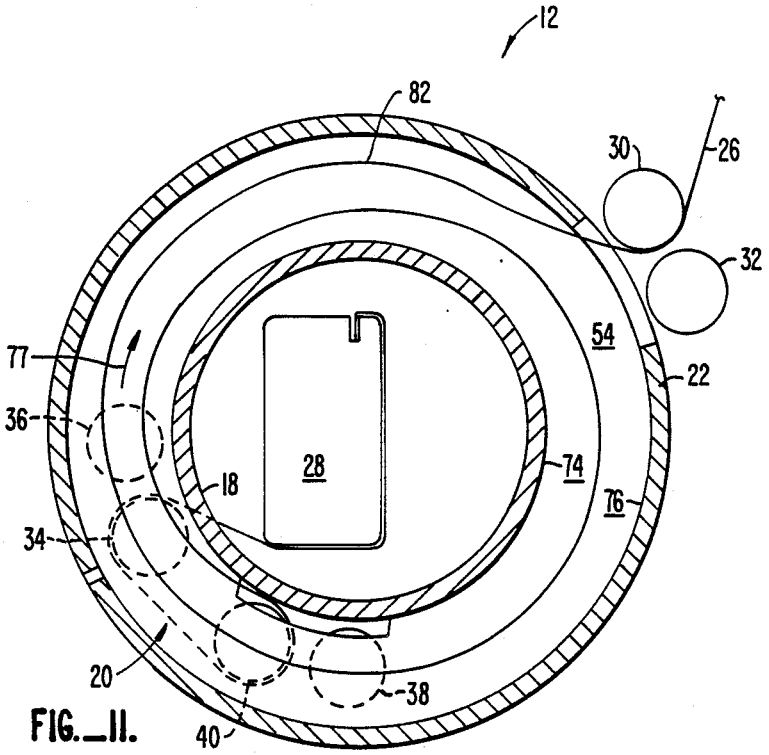
Figure 12:
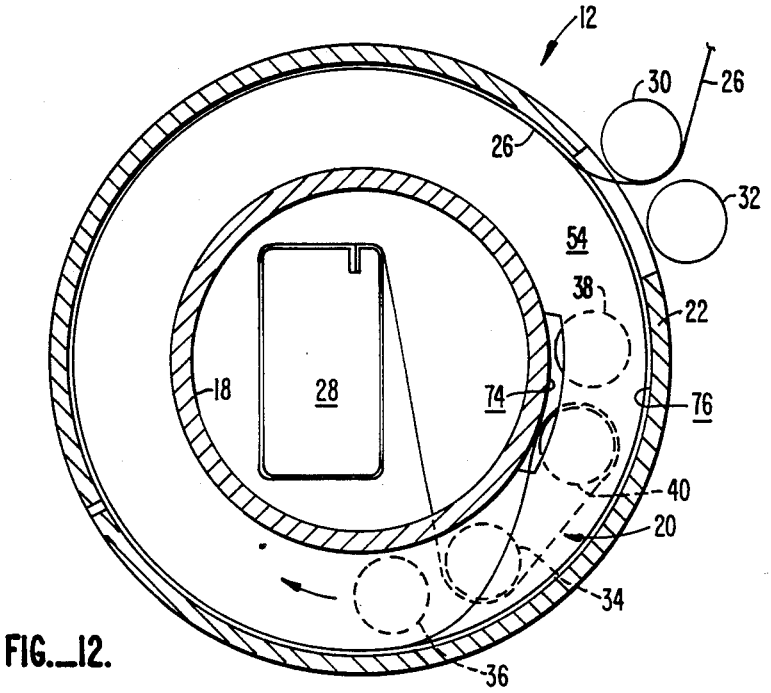

At FIG. 9 we see an end 78 of wire 26 fastened to mandrel 28 after being wound between pulleys 38, 40 and pulleys 34, 36. At FIG. 10 shuttle 20 begins to move clockwise causing wire 26 to be removed from surface 74, wire 26 first passing around pulley 40, then around winding pulley 34 and finally into the hollow interior 80 of magazine 18 where it is wound about mandrel 28. However, since the average circumferential length of surface 74 is much greater than the average circumferential length of mandrel 28, much more wire 26 is removed from surface 28 than is wound about mandrel 28. As indicated in FIG. 11, this excess wire, before it passes around pickup pulley 40 and winding pulley 34, expands in diameter and becomes loose within cavity 54. Loose wire 82 continues to expand outwardly until constrained by surface 76. FIG. 12 shows the point at which all wire 26 has been removed from surface 74 of magazine 18 and has been pushed against surface 76 of cage 22.

Figure 13:
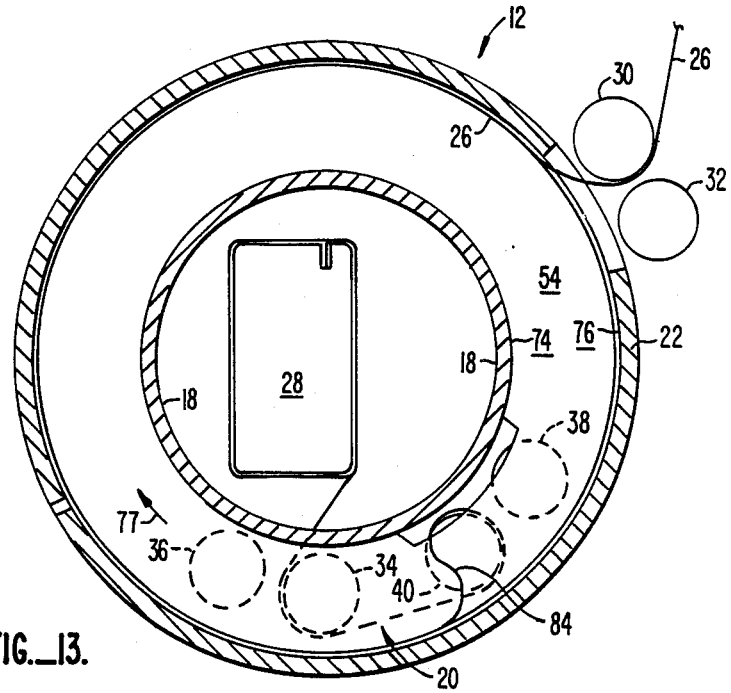
Figure 14:
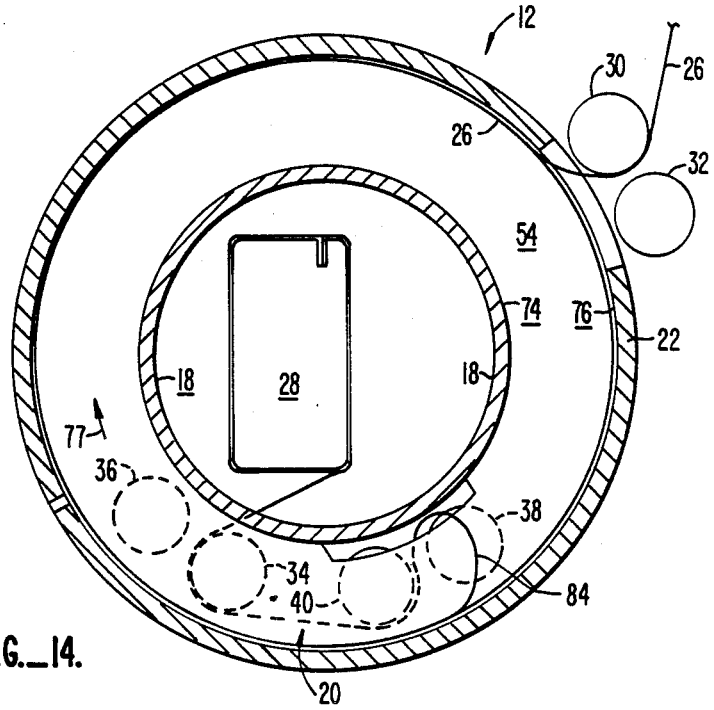
Figure 15:
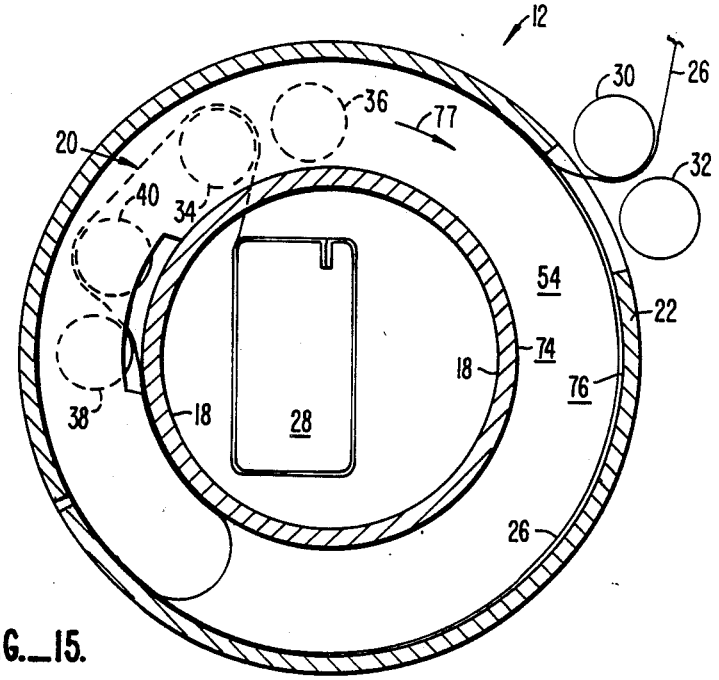

Continued movement of shuttle 20 in the direction of clockwise arrow 77 causes wire 26 to begin to form a loop 84, as shown in FIG. 13, because of the constraint of surface 76. FIG. 14 shows loop 84 completely formed while FIG. 15 shows how wire 26 begins unwinding from surface 76 and onto surface 74 as shuttle 20 continues moving in the direction of arrow 77.

Figure 16:
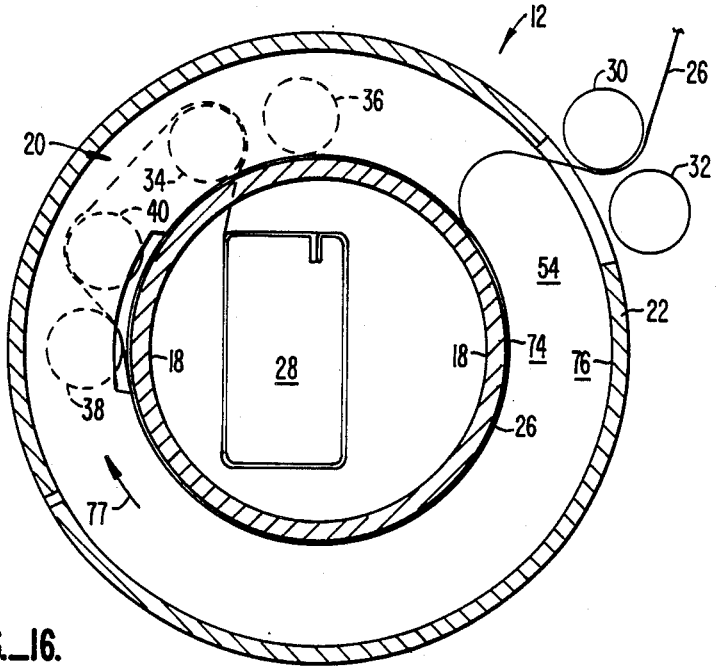
Figure 17:
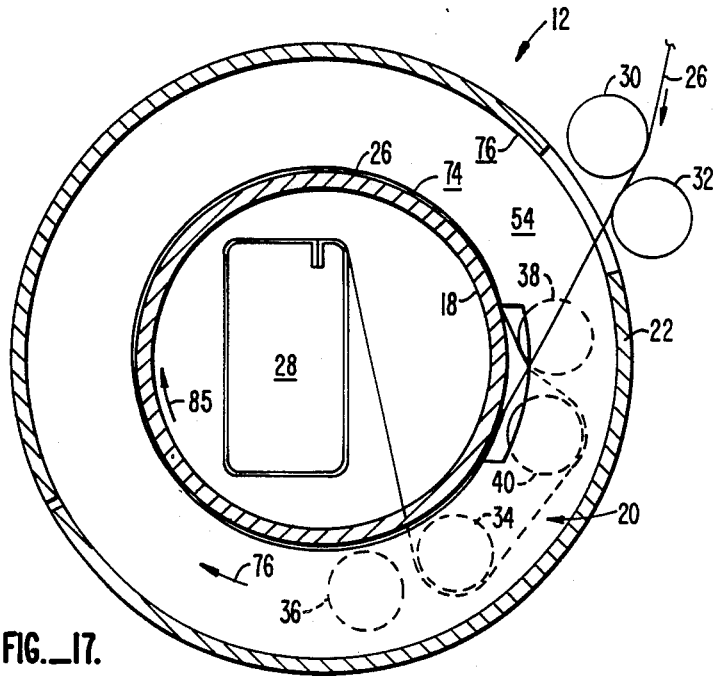

At FIG. 16 all wire 26 has been removed from surface 76 and deposited onto surface 74. This occurs immediately before wire 26 begins being wound onto magazine from supply 29 as shown in FIG. 17. During this portion of the cycle, magazine 18 rotates in a clockwise direction as indicated by arrow 85 because the action of shuttle 20 removing wire 26 from magazine 18 causes magazine 18, which had previously been generally stationary, to rotate in the direction of arrow 85.

At FIG. 18 wire 26 between pulleys 30, 32 and supply source 29 is again stationary. At FIG. 18 shuttle 20 is shown stopped after N/2 turns of wire 26 have been wound onto surface 74, where N equals the number of turns of the subsequent coil segment 70 to be wound about mandrel 28.

At FIG. 19 cut end 78′ of wire 26 is mounted to mandrel 28 in preparation for winding a new coil in the counterclockwise direction, as indicated by dashed arrow 86. Although FIG. 19 shows a mandrel 28 having no other wire 26 wound about it, the same mandrel 28 could be used to form multiple coils onto the mandrel as suggested in FIGS. 6 and 7. Thus, the condition of assembly 12 in FIG. 19 is similar to that shown in Fig. 9 except that magazine 18 has wire 26 wound in opposite rotary directions. Subsequent movement of shuttle 20 of FIG. 19 will thus occur in the counterclockwise rotary direction as indicated by arrow 86, which is opposite arrow 76 of FIGS. 10–17.

Modification and variation can be made to the disclosed embodiment without departing from the subject of the invention as defined in the following claims. For example, wire 26 could be replaced by multiple strands of wire. Surface 76 could be a mesh cage rather than a substantially continuous, hole-free surface. The invention has applicability for winding lengths of wire or like material for purposes other than making transformers.

What is claimed is:

1. A self-loading wire winding assembly, for use with a mandrel, a mandrel support, a wire supply and a coil winding machine having a frame and a shuttle drive, the mandrel supported by the mandrel support, for winding wire from the wire supply around the mandrel so to create a coil segment of wire on the mandrel, the winding assembly comprising:

a circumferential cage, mounted to the frame, having a radially outward, inwardly facing first surface;

a circumferential winding magazine, freely rotatably mounted within the cage, having a radially inward, outwardly facing second surface, the first and second surfaces defining a cavity therebetween, the magazine having an interior within which the mandrel can move; and a winding shuttle, drivenly coupled to the shuttle drive for movement within the cavity and around the second surface in first and second rotary directions, the winding shuttle configured for winding wire housed within the cavity onto the mandrel as the shuttle rotates around the mandrel, the first and second surfaces sized so that a reverse loop of wire can be accommodated between them and wherein the sole rotational force on the magazine is the pull of the wire caused by rotation of the winding shuttle.

2. The assembly of claim 1 wherein the cage is circular.

3. The assembly of claim 1 wherein the cage is mounted to the frame is to be stationary relative to the frame.

4. The assembly of claim 1 wherein the magazine is mounted on guide pulleys attached to the frame.

5. The assembly of claim 1 wherein the magazine is circular.

6. The assembly of claim 1 wherein the magazine defines a L-shaped storage channel and the storage channel and the first surface define an annular cavity.

7. The assembly of claim 1 wherein the shuttle includes first and second wire pick-up pulleys.

8. The assembly of claim 1 wherein the shuttle includes first and second wire winding pulleys.

9. The assembly of claim 1 wherein the cage includes a circumferential opening through which wire from the wire supply passes.

10. A method for winding a continuous length of wire from a wire supply about a mandrel in at least one of first and second rotary directions to create at least one coil segment on the mandrel using a coil winding machine of the type including a frame and a shuttle drive, comprising the following steps:

(a) pre-winding, in the first rotary direction, a length of wire from the wire supply onto a radially inward, outwardly facing second surface of a circumferential, freely rotatable, winding magazine, the second surface having a second effective circumferential length;

(b) effectively positioning the mandrel within the second surface;

(c) coupling the wire to a shuttle;

(d) connecting an outer end of the wire to the mandrel. the mandrel having a third effective circumferential length, the third length being substantially less than the second length;

(e) rotating the shuttle in the second rotary direction around the second surface, the difference between the second and third lengths causing the wire to unwind from the second surface at a rate in excess of the rate at which the wire is wound onto the mandrel causing the excess wire to move outwardly into a cavity defined between the second surface and a radially outward first surface;

(f) restraining the outward movement of the excess wire by the first surface, the first surface having a first effective circumferential length;

(g) continuing to restrain the outward movement of the excess wire until substantially all of the excess wire is restrained by the first surface, after which continued movement of the shuttle in the first rotary direction causes the excess wire to double back upon itself forming a loop of the excess wire in the cavity after which the excess wire is re-wound back onto the second surface in the second rotary direction as the shuttle continues to move in the second rotary direction until all of the excess wire is re-wound back onto the second surface;

(h) thereafter continuing to move the shuttle in the second rotary direction causing the magazine to rotate in the second rotary direction thereby winding wire from the wire supply onto the magazine in the second rotary direction while the shuttle continues to wind wire onto the mandrel in the second rotary direction; and (i) repeating steps d through h while interchanging the first and second rotary directions.

11. The method of claim 10 further comprising the step of replacing the mandrel after step i.

12. The method of claim 10 wherein the restraining step is carried out using an inwardly facing first surface.

13. The method of claim 12 wherein the restraining step is carried out using a substantially continuous first surface.

14. The method of claim 10 wherein the prewinding step is carried out using a circular winding magazine.

15. A method of producing a multifilar winding, said method utilizing a winding mandrel and an annular wire storage means encircling said mandrel including a magazine which is rotatably driven about said mandrel to wind an initial supply of wire from an external source of wire onto a radially-inward annular surface thereof to form a coil of said wire and which is thereafter freely rotatable about said mandrel to deliver said wire from said coil for winding on said mandrel and a cage which is rotatably stationary with respect to said machine providing a radially-outward annular surface facing said radially-inward annular surface for constraining the diameter of said coil of wire when said coil of wire is unwound in a manner to cause an increase in the diameter of said coil of wire, said method further utilizing a winding shuttle including wire guide means which is rotatably driven about said mandrel for guiding wire from said storage means to be wound upon said mandrel as said wire guide means rotates, said method comprising the steps of:

(a) loading an initial supply of wire from: said external source of wire onto said radially-inward annular surface of said magazine by rotating said magazine about said mandrel to form said coil of wire within said wire storage means;

(b) rotating said guide means about said mandrel in a first direction to begin winding a first pass of a winding onto said mandrel while allowing said magazine to freely rotate to:

(1) remove wire from said coil of wire within said wire storage means at a first rate substantially proportional to the circumference of the mandrel, and (2) unwind said coil of wire within said wire storage means initially at a second rate substantially proportional to the diameter of said radially-inward annular surface of said magazine and thus greater than said first rate to thereby cause the diameter of said coil of wire to increase, (c) continuing to rotate said guide means about said mandrel in said first direction to continue to wind said first pass of said winding onto said mandrel while allowing said magazine to freely rotate to:

(1) continue to remove wire from said coil of wire within said wire storage means for winding on said mandrel, and (2) continue to unwind said coil of wire within said wire storage means to cause an increase in the diameter of said coil of wire until said diameter of all of the turns of said coil of wire are constrained by said radially-outward annular surface of said magazine and further increase in the diameter of said coil of wire is prevented, (d) continuing to rotate said guide means about said mandrel in said first direction to continue to wind said first pass of said winding onto said mandrel while allowing said magazine to freely rotate to:

(1) continue to remove wire from said coil of wire within said wire storage means for winding on said mandrel, and (2) form a loop within said wire storage means when the diameter-constrained wire winds back upon said radially-inward annular surface of said magazine in a direction opposite the direction said supply of wire was initially wound upon said radially-inward annular surface of said magazine, (e) continuing to rotate said guide means about said mandrel in said first direction to continue to wind said first pass of said winding onto said mandrel while allowing said magazine to freely rotate to:

(1) continue to remove wire from said coil of wire within said wire storage means for winding on said mandrel, and (2) wind the remaining diameter-constrained wire upon said radially-inward annular surface of said magazine so that the entirety of the remaining wire stored in said wire storage means is wound onto said radially-inward annular surface of said magazine in a direction opposite the direction said supply of wire was initially wound upon said radially-inward annular surface of said magazine, (f) continuing to rotate said guide means about said mandrel in said first direction to complete the winding of said first pass of said winding onto said mandrel while allowing said magazine to freely rotate to:

(1) continue to remove wire from said coil of wire within said wire storage means for winding on said mandrel, and (2) wind wire from said external source of wire onto said radially-inward annular surface of said magazine to replenish the supply of wire stored in said wire storage means for winding the next pass of said winding, (g) reversing the direction of rotation of said guide means to wind the next pass of said winding onto said mandrel while allowing said magazine to freely rotate; and (h) repeating steps a through f to remove wire from said wire storage means for said next pass of said winding and to replenish wire from said external source of wire for the next subsequent pass of said winding.

16. A self-loading wire winding assembly, for use with a mandrel, a mandrel support, a wire supply and a coil winding machine having a frame and a shuttle drive, the madrel supported by the mandrel support, for winding wire from the wire supply around the mandrel so to create a coil segment of wire on the mandrel, the winding assembly comprising:

a circumferential cage, mounted to the frame, having a radially outward, inwardly facing first surface;

a circumferential winding magazine, freely rotatably mounted within the cage, having a radially inward, outwardly facing second surface, the first and second surfaces defining a cavity therebetween, the magazine having an interior within which the mandrel can move;

a winding shuttle, drivenly coupled to the shuttle drive for movement within the cavity and around the second surface in first and second rotary directions, the winding shuttle configured for winding wire housed within the cavity onto the mandrel as the shuttle rotates around the mandrel, the first and second surfaces sized so that a reserved loop of wire can be accommodated between them and wherein the sole rotational force on the magazine is the pull of the wire caused by rotation of the winding shuttle; and the winding shuttle including first and second winding guides having winding circumferences positioned opposite one another and first and second wire pick-up guides having pick-up circumferences positioned opposite one another, the wire passing between the first and second pick-up guides, between the first and second winding guides and then to the mandrel.

17. The assembly of claim 16 wherein the first and second winding guides include first and second winding pulleys and the first and second pick-up guides include first and second pick-up pulleys, said winding and pick-up pulleys having circunferential grooves sized to accept the wire.

18. The assembly of claim 17 wherein winding pulleys are oriented at an acute angle to the pick-up pulleys.

* * * * *